US011447158B2

(12) United States Patent
Gronau

(10) Patent No.: US 11,447,158 B2
(45) Date of Patent: Sep. 20, 2022

(54) SAND STAIRWAY FOR A SAND-SPREADING SYSTEM OF A RAIL VEHICLE, SAND-SPREADING SYSTEM AND RAIL VEHICLE

(71) Applicant: SIEMENS MOBILITY GMBH, Munich (DE)

(72) Inventor: Hans-Joachim Gronau, Vierkirchen (DE)

(73) Assignee: Siemens Mobility GmbH, Munich (DE)

( * ) Notice: Subject to any disclaimer, the term of this patent is extended or adjusted under 35 U.S.C. 154(b) by 847 days.

(21) Appl. No.: 16/334,875

(22) PCT Filed: Aug. 16, 2017

(86) PCT No.: PCT/EP2017/070697
§ 371 (c)(1),
(2) Date: Mar. 20, 2019

(87) PCT Pub. No.: WO2018/054611
PCT Pub. Date: Mar. 29, 2018

(65) Prior Publication Data

US 2020/0023866 A1 Jan. 23, 2020

(30) Foreign Application Priority Data

Sep. 20, 2016 (DE) ..... 10 2016 217 982.9

(51) Int. Cl.
*B61C 15/10* (2006.01)

(52) U.S. Cl.
CPC ..... *B61C 15/102* (2013.01)

(58) Field of Classification Search
CPC ... B61C 15/085; B61C 15/102; B60B 39/023; E01C 19/205
See application file for complete search history.

(56) References Cited

U.S. PATENT DOCUMENTS 1,388,811 A 8/1921 Fowler
1,854,994 A 4/1932 Light et al.
(Continued)

FOREIGN PATENT DOCUMENTS

DE 1279057 B 10/1968
DE 2617331 C3 10/1981
(Continued)

*Primary Examiner* — Robert J McCarry, Jr.
(74) *Attorney, Agent, or Firm* — Laurnece A. Greenberg; Werner H. Stemer; Ralph E. Locher

(57) ABSTRACT

A sand stairway for a sand-spreading system of a rail vehicle has a stairway housing with a sand compartment for providing sliding spreading sand. A blow-out duct discharges spreading sand from the stairway housing. First and second nozzle inserts are releasably inserted into first and second receiving holes of a nozzle flange of the stairway housing above the sand compartment. The nozzle inserts are produced separately from the stairway housing. The first nozzle insert produces an air jet directed into the sand compartment and swirls up spreading sand. The second nozzle insert produces an air jet directed into the blow-out duct and swirls up spreading sand. A sand-spreading system for a rail vehicle has a sand stairway for the compressed-air-controlled metering of the discharged spreading sand. The novel sand stairway has increased flexibility and can be set up without great effort for using different types of spreading sand.

10 Claims, 1 Drawing Sheet

(56) References Cited

U.S. PATENT DOCUMENTS

| | | | | | |
|---|---|---|---|---|---|
| 2,431,382 | A | * | 11/1947 | Elsworth | B61C 15/102 291/11.2 |
| 2,499,114 | A | | 2/1950 | Saari et al. | |
| 2018/0072329 | A1 | | 3/2018 | Krismanic et al. | |

FOREIGN PATENT DOCUMENTS

| | | | | | |
|---|---|---|---|---|---|
| DE | 220863 | A1 | | 4/1985 | |
| EP | 1612117 | A1 | * | 1/2006 | B60T 8/56 |
| WO | 2016134397 | A1 | | 9/2016 | |

* cited by examiner

SAND STAIRWAY FOR A SAND-SPREADING SYSTEM OF A RAIL VEHICLE, SAND-SPREADING SYSTEM AND RAIL VEHICLE

BACKGROUND OF THE INVENTION

Field of the Invention

The invention relates to a sand stairway for a sand-spreading system of a rail vehicle, comprising a stairway housing with a sand compartment for providing progressively sliding spreading sand and with a blow-out duct for discharging spreading sand from the stairway housing, and a first nozzle for producing an air jet which is directed into the sand compartment and swirls up spreading sand, and a second nozzle for producing an air jet which is directed into the blow-out duct and discharges swirled-up spreading sand. The invention further relates to a sand-spreading system as claimed and to a rail vehicle as claimed.

A rail vehicle, in particular a locomotive or a multiple unit, has rail wheels which can be driven and/or braked. In order to obtain an optimum coefficient of friction between rail wheel and rail upon starting, upon braking and during the journey of the rail vehicle, spreading sand is introduced as required into the gap between rail wheel and rail by means of a sand-spreading system. Such a sand-spreading system comprises a sand box for storing spreading sand, a sand stairway fastened to the sand box and intended for the compressed-air-controlled metering of the spreading-sand output, and a sand outlet pipe which is connected via a sand hose to the sand stairway and which opens in front of a rail wheel.

Sand-spreading systems having such sand stairways are long-established and known, for example, from German Auslegeschrift DE 12 79 057 A1 and patent DE 26 17 331 C3. Such a sand stairway comprises a stairway housing with a sand compartment for providing progressively sliding spreading sand, with a blow-out duct for discharging spreading sand from the stairway housing and with a siphon-like knee region in the transition from the sand compartment to the blow-out duct. Arranged in the knee region are a first nozzle for producing an air jet which is directed into the sand compartment and which swirls up spreading sand, and a second nozzle for producing an air jet which is directed into the blow-out duct and which discharges swirled-up spreading sand through the blow-out duct.

According to DE 12 79 057 A1, a nozzle plate having two parallel nozzles of the same diameter is situated on an annular collar in the knee region of the stairway housing, of which the first nozzle is directed toward the sand compartment, and the second nozzle is directed toward the blow-out duct. The nozzle plate is fastened by means of a transition double nipple which is screwed into the stairway housing and to which a compressed-air line can be connected.

In DE 26 17 331 C3, a compressed-air line is fed in from above over the blow-out duct and the sand compartment in the knee region and is fastened to the stairway housing by means of a screw connection. The two nozzles are arranged therebetween in a nozzle holder, of which the first nozzle is directed toward the sand compartment, and the second nozzle is directed toward the blow-out duct. The plate-shaped nozzle holder is formed by the central part of a push-in element which is inserted into the stairway housing and which can be manually exchanged upon formation of spreading-sand deposits which impair the function of the sand stairway.

The known nozzles are formed as parallel bores in a plate-shaped component. The nozzles are fixed in terms of their nozzle diameter for the sand stairway, with the result that the use flexibility for different spreading-sand varieties is absent or is only possible by a complicated replacement of the complete nozzle holder or of the nozzle plate.

BRIEF SUMMARY OF THE INVENTION

The object on which the invention is based is therefore to provide a sand stairway of the type stated at the outset which has improved use flexibility and can be set up in particular without great effort for the use of different varieties of spreading sand.

The object is achieved according to the invention by a sand stairway of the type in question having the features as claimed. Accordingly, the stairway housing has, above the sand compartment and the blow-out duct, a nozzle flange with a first receiving bore and a second receiving bore. Here, the first nozzle is formed by a first nozzle insert, and the second nozzle is formed by a second nozzle insert, which are in each case produced separately from the stairway housing. The first nozzle insert is releasably inserted into the first receiving bore, and the second nozzle insert is releasably inserted into the second receiving bore. According to the invention, the nozzles are not produced directly in the material of the stairway housing by means of bores, but in nozzle inserts produced separately from the stairway housing. As a result, the nozzle diameters can be produced more precisely and with considerably smaller tolerances than the stairway housing. Since the nozzle inserts are releasably plugged into receiving bores of the nozzle flange, they can, on the one hand, be tailored in terms of their nozzle diameter to the spreading sand used by the operator and, on the other hand, upon contamination or upon a change of the spreading sand, be quickly replaced with new nozzle inserts or those having other nozzle diameters. Likewise, the first and second nozzle insert can be changed in a simple manner in terms of their nozzle diameters from the same nozzle diameters to different ones, and vice versa, depending on the operating requirements.

In one advantageous embodiment, the sand stairway according to the invention comprises a compressed-air flange which is releasably fastened to the nozzle flange in a compressed-air-tight manner and which has, extending therein, a compressed-air duct which leads from a connection opening for a compressed-air line to a first outlet, which opens into the first nozzle insert, and to a second outlet, which opens into the second nozzle insert. The compressed-air flange is placed, with the interposition of a seal, on the nozzle flange and fastened rapidly thereto by means of a releasable screw connection. By virtue of the compressed-air flange being produced separately from the stairway housing, said flange can likewise be produced in a simple and cost-effective manner. Since the two nozzle inserts can be reached by the compressed-air duct, a single compressed-air line is sufficient for producing the two air jets.

In one preferred embodiment of the sand stairway according to the invention, a nozzle diameter of the first nozzle insert is dimensioned to be smaller than a nozzle diameter of the second nozzle insert. It is thereby possible with a common compressed-air supply, for the first air jet for swirling up the spreading sand to be designed to be weaker than the second air jet which discharges the swirled-up spreading sand from the sand stairway through the blow-out pipe.

In one advantageous embodiment of the sand stairway according to the invention, the first nozzle insert and the second nozzle insert can in each case be selected from a set of nozzle inserts having differently dimensioned nozzle diameters corresponding to a particle size of the spreading sand used. In this embodiment, a set of a plurality of nozzle inserts having different nozzle diameters belongs to the sand stairway, with it also being possible for a plurality of nozzle inserts to belong to each of the nozzle diameters. As a result, the flexibility of the operator in terms of the particle size of the spreading sand used and the down time upon a change of a nozzle insert are substantially improved.

In one preferred embodiment of the sand stairway according to the invention, the stairway housing is produced as a one-piece fine casting or 3D-printed part. Producing the stairway housing by means of one of these production processes means that the stairway housing of the sand stairway according to the invention can be produced with higher dimensional accuracy than, for example, through the sand-casting process used hitherto. This results in complicated finishing work being dispensed with, and the dimensional deviations within a production series are substantially less than hitherto, which has a positive effect on observing the officially predetermined tolerances in terms of the permitted sand ejection quantities.

The stairway housing of the sand stairway according to the invention preferably consists of stainless steel. By comparison with the gray cast iron used hitherto, the use of stainless steel means that post-treatments for corrosion protection can be dispensed with.

In a further advantageous embodiment of the sand stairway according to the invention, the nozzle inserts are designed as turned brass parts. Turned brass parts can be produced in large number and with a high degree of precision and are available on the market in a cost-effective manner. The use of such nozzle inserts or sets of nozzle inserts means that they can be provided with dimensionally accurate nozzle diameters.

The invention further relates to a sand-spreading system for a rail vehicle having rail wheels which can be driven and/or braked. Said system comprises a sand box for storing spreading sand, a sand stairway fastened to the sand box and intended for the compressed-air-control metering of the spreading-sand output, and a sand outlet pipe which is connected via a sand hose to the sand stairway and opens ahead of a rail wheel. Here, the sand stairway is designed as claimed.

The invention additionally relates to a rail vehicle, in particular a locomotive, having at least one rail wheel which can be driven and/or braked and a sand-spreading system as claimed.

BRIEF DESCRIPTION OF THE SEVERAL VIEWS OF THE DRAWING

Further properties and advantages of the invention will become apparent from the following description of the drawings, in which FIG. 1 schematically illustrates a sand stairway according to the invention in plan view, and FIG. 2 schematically illustrates a longitudinal section through the sand stairway along the section line II-II indicated in FIG. 1.

DESCRIPTION OF THE INVENTION

Figure 1:
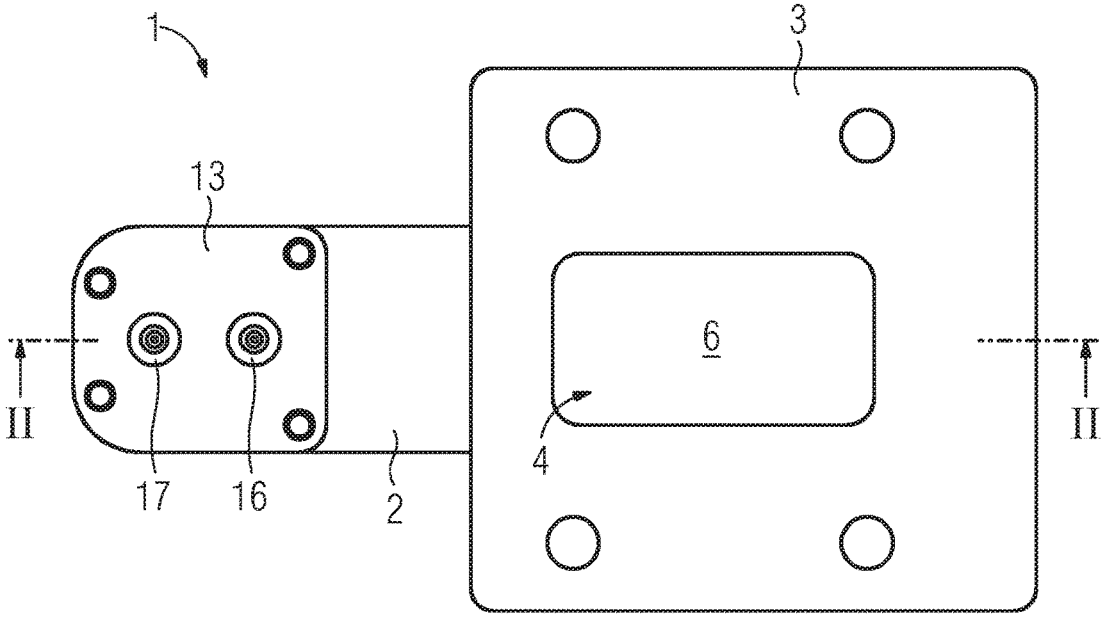
Figure 2:
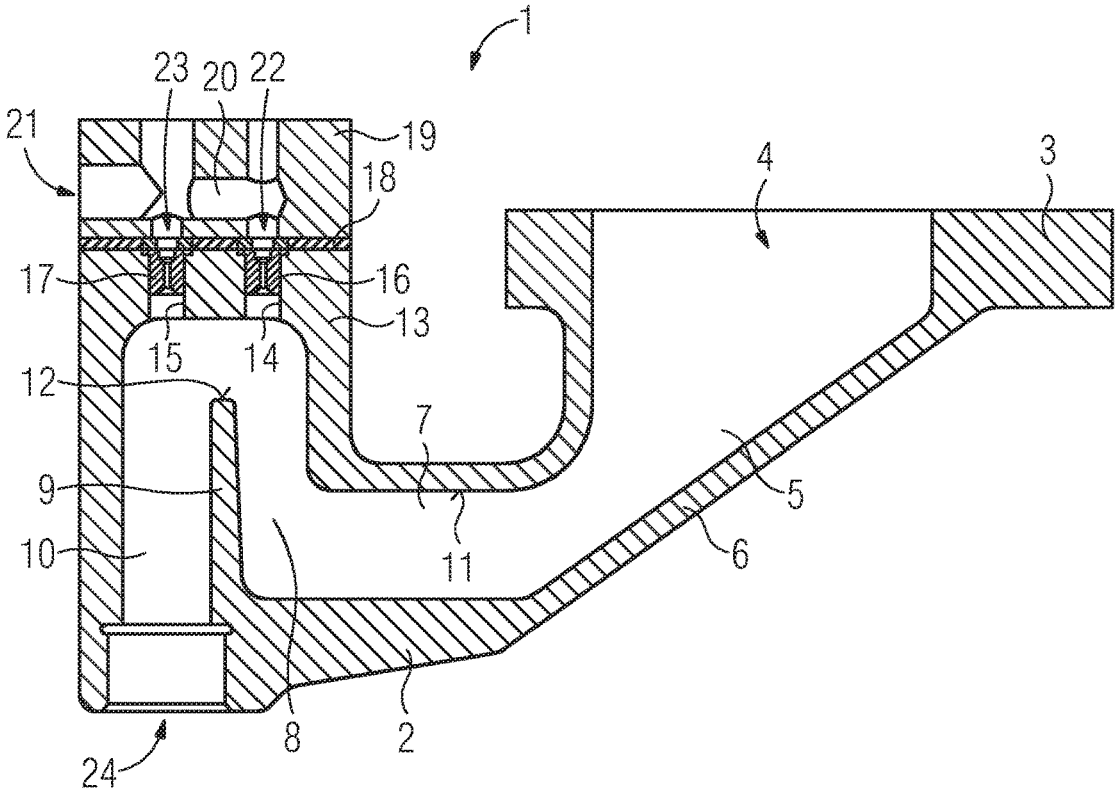

A sand stairway 1 shown in FIG. 1 and FIG. 2 serves for the compressed-air-controlled metering of the spreading-sand output of a sand-spreading system, which is known per se in its entirety and therefore not illustrated, for a rail vehicle, which is likewise not illustrated. The rail vehicle comprises rail wheels which can be driven and/or braked, and can be, for example, a locomotive or a multiple unit. The sand-spreading system further includes a sand box for storing spreading sand which progressively slides into the sand stairway 1. Spreading sand leaves the sand stairway 1 through a sand hose (not shown), which in turn is connected to a sand outlet pipe which opens ahead of the rail wheel in the direction of travel. The stairway housing 2 is designed as a one-piece component, in particular as a fine casting or 3D-printed part, the high dimensional accuracy of which avoids associated finishing work. Here, it can be produced in particular from stainless steel, with the result that separate measures for corrosion protection can be dispensed with. A siphon-like, substantially S-shaped sand path extends through the stairway housing 2. The stairway housing 2 has a fastening flange 3 for fastening it to the sand box. Spreading sand exits the sand box through a sand inlet opening 4 provided in the fastening flange 3 and slides into an adjoining, funnel-shaped trough 5 of the stairway housing 2. The bottom wall 6 of the trough 5 expediently has an angle of inclination which is greater than the pouring angle of the spreading sand used. The trough 5 is adjoined by a horizontal, relatively narrow duct section 7 which acts as a throttle point for the progressively sliding spreading sand. This avoids a situation in which an excessive amount of spreading sand slides progressively out of the sand box when the rail vehicle is subject to vibrations. The duct section 7 opens into a sand compartment 8 which is separated by a vertical partition 9 from a blow-out duct 10 of the stairway housing 2. Here, an apex 11 of the duct section 7 is situated below an upper edge 12 of the partition 9 and thus below an inlet opening of the blow-out duct 10 which extends vertically downward therefrom. A nozzle flange 13 (not illustrated in FIG. 1), in which two vertical receiving bores 14 and 15 configured as through-holes are arranged, is formed above the blow-out duct 10 and the sand compartment 8 in a knee region of the stairway housing 2. A first nozzle insert 16 is releasably inserted into the first receiving bore 14, and a second nozzle insert 17 is releasably inserted into the second receiving bore 15. The nozzle inserts 15 and 16 are preferably configured as turned parts consisting of brass and can thereby be produced with a high degree of precision in terms of their nozzle diameters. A compressed-air flange 19 is placed on the nozzle flange 13 in a compressed-air-tight manner with the interposition of a seal 18 but releasably fastened by means of a screw connection. Within the compressed-air flange 13, a compressed-air duct 20 extends from a connection opening 21 for a compressed-air line (not illustrated) to a first outlet 22, which opens into the first nozzle insert 16, and leads to a second outlet 23, which opens into the second nozzle insert 17. Compressed air is fed in via the compressed-air flange 19 to the nozzle flange 13 of the stairway housing 2, flows through the first nozzle insert 16 into the sand compartment 8 and produces an air jet for swirling up spreading sand. The compressed air also flows through the second nozzle insert 17 and produces an air jet which discharges the swirled-up spreading sand through the blow-out duct 10. Since the nozzle inserts 16 and 17 are jointly supplied with compressed air, the nozzle diameter of the first nozzle insert 16 can be dimensioned to be smaller than the nozzle diameter of the second nozzle insert 17 if the conveying air jet may have a greater volumetric flow than the swirling-up air jet. The swirled-up spreading sand is entrained by the air jet and conveyed through the blow-out duct 10, which it leaves through a sand outlet opening 24 of the stairway housing 2. The sand hose terminating with a sand outlet pipe is connected to the sand outlet opening 24 and jets the gap between rail wheel and rail with spreading sand to increase the coefficient of friction.

According to FIG. 2, the first and second nozzle insert 16 and 17 are turned from brass as cylindrical sleeves. They have an axial through-bore which defines the precise nozzle diameter. The through-bores have conical countersinks at the downstream end, whereas they are cylindrically drilled at the upstream end. At the latter end, the nozzle inserts 16 and 17 in each case have a flat, cylindrical extension which fits into a corresponding countersink of the receiving bores 14 and 15. The shape thereof allows a simple plugging of the nozzle inserts 16 and 17 into the receiving bores 14 and 15 and a likewise simple removal, with the result that, in the sand stairway 1 according to the invention, a change of nozzle inserts 16 and/or 17 can be carried out without great effort. As a result, clogged nozzle inserts 16 and 17 can be quickly replaced with clean ones, or the nozzle inserts 16 and 17 can be exchanged for others having smaller or larger nozzle diameters. For this purpose, a set of nozzle inserts 16 and 17 having different nozzle diameters is available according to the invention.

The invention claimed is:

1. A sand stairway for a sand-spreading system of a rail vehicle, the sand stairway comprising:

a stairway housing with a sand compartment for providing progressively sliding spreading sand and with a blow-out duct for discharging spreading sand from the stairway housing;

a nozzle flange disposed above said sand compartment and said blow-out duct, said nozzle flange being formed with a first receiving bore and a second receiving bore;

a first nozzle for producing an air jet that is directed into said sand compartment for swirling up spreading sand, said first nozzle having a first nozzle insert produced separately from said stairway housing and releasably inserted into said first receiving bore;

a second nozzle for producing an air jet that is directed into said blow-out duct for discharging swirled-up spreading sand, said second nozzle having a second nozzle insert produced separately from said stairway housing and releasably inserted into said second receiving bore;

said nozzle inserts having nozzle diameters tailored to a type of spreading sand used in the sand-spreading system;

said nozzle inserts being replaceable upon contamination; and said nozzle inserts selectively having mutually different nozzle diameters or identical nozzle diameters, in dependence on operating requirements.

2. The sand stairway according to claim 1, comprising a compressed-air flange releasably fastened to said nozzle flange in a compressed-air-tight manner and, extending therein, a compressed-air duct which leads from a connection opening for a compressed-air line to a first outlet, which opens into said first nozzle insert, and to a second outlet, which opens into said second nozzle insert.

3. The sand stairway according to claim 1, wherein a nozzle diameter of said first nozzle insert is smaller than a nozzle diameter of said second nozzle insert.

4. The sand stairway according to claim 1, wherein each said first and second nozzle inserts are selected from a set of nozzle inserts having differently dimensioned nozzle diameters corresponding to a particle size of the spreading sand used.

5. The sand stairway according to claim 1, wherein said stairway housing is a one-piece fine casting or a 3D-printed part.

6. The sand stairway according to claim 5, wherein said stairway housing consists of stainless steel.

7. The sand stairway according to claim 1, wherein said nozzle inserts are turned brass parts.

8. A sand-spreading system for a rail vehicle having rail wheels to be driven and/or braked, the sand-spreading system comprising:

a sand box for storing spreading sand;

a sand stairway according to claim 1 fastened to said sand box and configured for compressed-air-controlled metering of a spreading-sand output; and a sand outlet pipe connected via a sand hose to said sand stairway and opening ahead of a rail wheel in a travel direction.

9. A rail vehicle, comprising:

at least one rail wheel to be driven and/or braked; and a sand-spreading system having:

a sand box for storing spreading sand;

a sand stairway according to claim 1 fastened to said sand box and configured for compressed-air-controlled metering of a spreading-sand output; and a sand outlet pipe connected to said sand stairway and opening ahead of said at least one rail wheel in a travel direction of the rail vehicle.

10. The rail vehicle according to claim 9 being a locomotive.

* * * * *